United States Patent [19]

Miller

[11] 4,213,780

[45] * Jul. 22, 1980

[54] METHOD OF INTRODUCING CALCIUM AND CALCIUM ALLOYS INTO A VESSEL OF MOLTEN METAL

[75] Inventor: Eldon D. Miller, Zelienople, Pa.

[73] Assignee: Lava Crucible Refractories Co., Pittsburgh, Pa.

[ * ] Notice: The portion of the term of this patent subsequent to Jan. 15, 1997, has been disclaimed.

[21] Appl. No.: 924,080

[22] Filed: Jul. 12, 1978

[51] Int. Cl.[2] ..... C21C 7/02

[52] U.S. Cl. ..... 75/58; 75/53; 75/130 R

[58] Field of Search ..... 75/53, 58, 130 R

[56] References Cited

U.S. PATENT DOCUMENTS

| | | | |
|---|---|---|---|
| 3,501,291 | 3/1970 | Schneider | 75/53 |
| 3,885,957 | 5/1975 | Richter | 75/53 |
| 4,067,730 | 1/1978 | Klapdar | 75/53 |
| 4,088,477 | 5/1978 | Hetke | 75/130 R |
| 4,094,666 | 6/1978 | Otatani | 75/53 |

OTHER PUBLICATIONS

"Blowing Calcium into Molten Steel Produces Low--Sulfur Plate for Lukens, US Steel, Metal Producing, Jul. 1977, (pp. 41-44).

*Primary Examiner*—P. D. Rosenberg

*Attorney, Agent, or Firm*—Webb, Burden, Robinson & Webb

[57] ABSTRACT

A method of treating molten metals comprising heating and extruding into the lower portion of a vessel containing the molten metals, an extrudable composition. The extrudable composition commprises calcium metal and sodium metal with said sodium being present up to about five percent by weight of the composition. The sodium metal has a volume distribution defining a more or less honeycomb structure in the boundaries between calcium metal particles. The composition is heated at least just prior to being extruded into the vessel. The composition upon contacting the molten metal is friable and freely breaks away for rapid reaction with the molten metal. The sodium vaporizes and escapes from the metal serving to cause an agitation of the molten metal bath.

7 Claims, 1 Drawing Figure

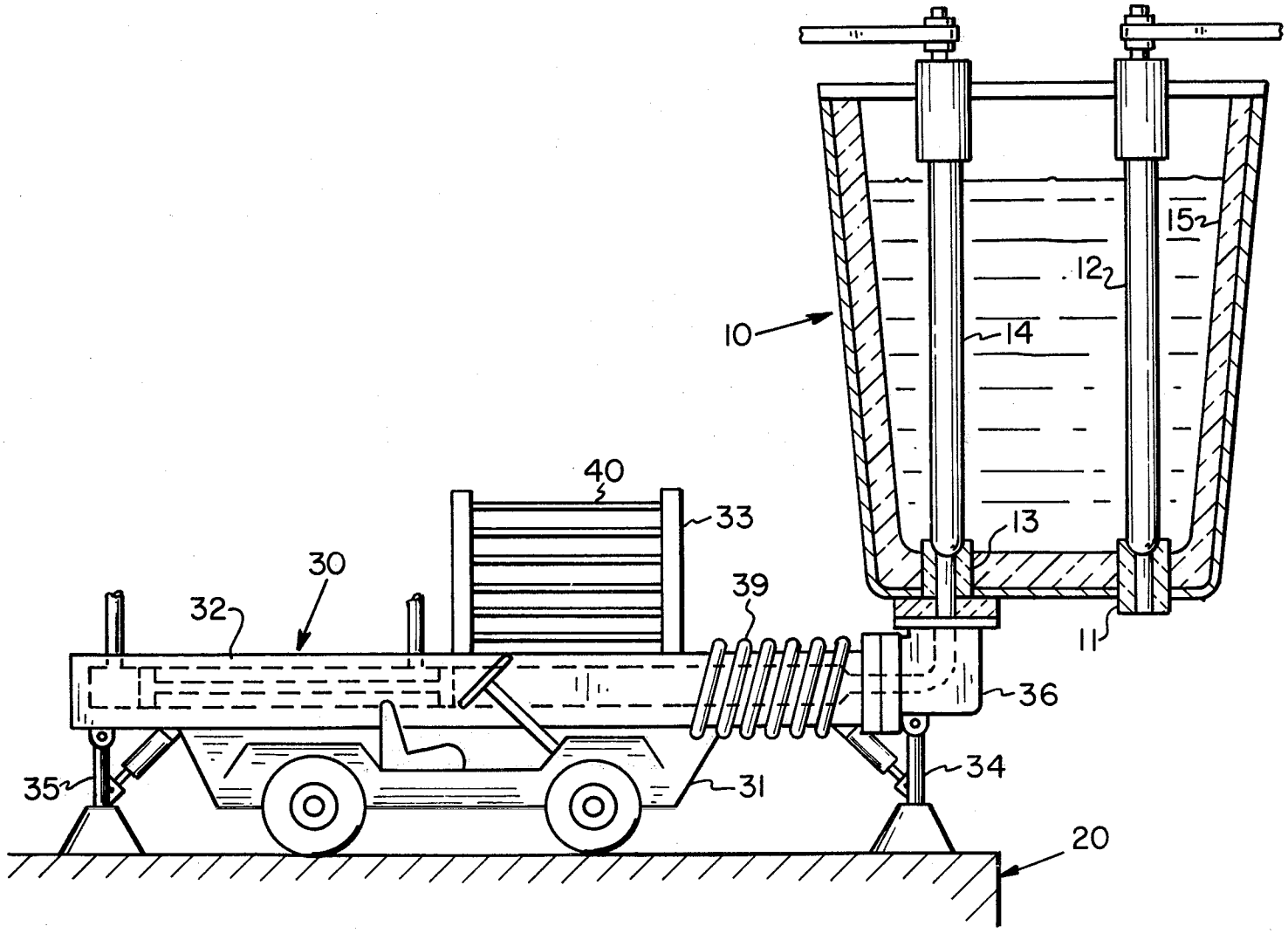
10
11
12
13
14
15
20
30
31
32
33
34
35
36
39
40

METHOD OF INTRODUCING CALCIUM AND CALCIUM ALLOYS INTO A VESSEL OF MOLTEN METAL

BACKGROUND

This invention relates to an improved process for deoxidation and desulfurization of steels. One of the natural impurities in steel is sulfur. Too much sulfur tends to make steel "hot-short", i.e., during rolling surface cracks develop as a result of iron-sulfide inclusions. The effect of iron sulfide inclusions is often minimized by the addition of manganese to the steel to form manganese sulfide inclusions which do not have the same damaging effect. Recently, however, the use of calcium metal additions to the melt has been pursued as a means of substantially eliminating the sulfur from the steel. Lower sulfur steels are becoming increasingly important. Consider, for example, that steel parts for the Alaskan Pipe Line were fabricated substantially entirely from low sulfur steels.

U.S. Pat. No. 3,575,695 teaches desulfurization of molten steel by adding calcium and calcium alloys to the lower portion of a molten bath which has been subjected to a preliminary deoxidation step. The preliminary deoxidation step involves the typical manganese, silicon or aluminum additions to the batch. Because of its relatively high vapor pressure at steelmaking temperatures, calcium metal (as a powder, granule, or small lump) is added to the bath through a tube extending thereinto. The calcium metal is carried into a bath by an inert gas such as argon. U.S. Pat. Nos. 3,885,957 and 3,980,469 describe very similar processes for desulfurizing steel in a ladle by blowing calcium or calcium containing substances into the ladle through a refractory tube. According to the '957 patent only about ten percent of the calcium added is converted to calcium sulfide. In other words, the process is only ten percent efficient at reacting calcium with the sulfur in the metal to thereby remove the sulfur from the metal. This very low utilization rate of calcium metal is only one disadvantage of the blowing process for introducing calcium or calcium alloys. The large amounts of argon needed for the blowing process are expensive and create a pollution problem as the argon rises out of the molten metal bath carrying dust with it. Further, the refractory tube for introducing the argon and calcium is a continuing maintenance problem.

Because of the low utilization efficiency of the calcium metal using the blowing technique, the steel is first treated with expensive vacuum degassers and with aluminum additions to remove excess oxygen prior to the calcium addition. This allows the injected calcium or calcium alloy to combine directly with the sulfur in the steel without being diverted to deoxidizing the melt. (Calcium is more reactive with oxygen in the melt than with sulfur in the melt).

It is an advantage according to this invention to provide an improved method of deoxidizing and/or desulfurizing molten metal, for example, iron, steel and copper melts.

SUMMARY OF THE INVENTION

A method of treating molten metals comprises, as a first step introducing the metals into a refractory lined vessel. As a second step, an extrudable composition of calcium metal and sodium metal, said sodium present from about one-half to fourteen percent, preferably up to seven percent, by weight of the composition, is heated and extruded into the lower portion of the vessel containing the molten metal. According to a preferred process, the calcium metal and sodium metal are extruded into a ferrous melt to bring about deoxidation and/or desulfurization of the melt.

The heating step takes place before the extruding step and it is only essential that the heating step raise the temperature of the calcium metal and sodium metal to in excess of 100° C., preferably, 400° to 600° C. Generally, the temperature will be below the melting point of calcium.

The sodium is volume distributed in the calcium to define a more or less honeycomb structure such that the sodium is present at the boundaries between calcium particles. Thus, when the sodium vaporizes at least just prior to the time at which the composition is pushed into the molten metal, the calcium disperses and quickly enters the molten metal.

It is contemplated that in preferred embodiments, the extrusion will be through the bottom or side walls directly into the lower portion of the melt. However, it may also be through a refractory tube extending downwardly into the melt.

The extrusion step need only involve a slight reduction in cross-section of the extrusion column. The main function of the extrusion die is to provide a measure of control of the rate at which the calcium and sodium are introduced to the molten metal.

The sodium, upon entering the melt, rapidly vaporizes forming bubbles which in their movement to escape from the bath create agitation within the bath. This agitation aids in the distribution of the calcium and in the removal of the calcium oxides and sulfides formed by the reaction of the calcium with oxygen and sulfur.

DESCRIPTION OF PREFERRED EMBODIMENTS

Further features and other objects and advantages of this invention will become apparent from the detailed description made with reference to the drawing which is a partial section of apparatus useful in the practice of this invention.

Filed of even date herewith is U.S. Pat. application Ser. No. 923,952 entitled "System for Introducing Additive Agents into Vessel of Molten Metal." That application describes apparatus which would be suitable for the practice of the herein described method. Other apparatus, of course, may be used and reference to the co-pending application is no way meant to be a limitation of this application to the apparatus disclosed in the co-pending application.

According to a preferred embodiment and the best mode now contemplated by the applicant, a cast iron melt having a well-known composition is placed in a teeming ladle having, in addition to a pouring nozzle gated by a stopper or slide gate, an additive agent port. Secured to the additive agent port is a cylinder having a piston therein. The cylinder is provided with means for loading it with deoxidizer/desulfurizer compositions comprising calcium metal or calcium metal alloy chunks and up to five percent by weight sodium metal chunks. It is contemplated that the calcium and calcium alloy chunks may preferably be sized to be approximately one to three inches in diameter and the sodium metal chunks preferably less than about one-quarter of an inch in diameter. Between the port and the cylinder with which it is in communication, there is a die through which the composition can be extruded. The piston is then brought to exert pressure on the mixture compacting it and forcing it through the die. Preferably, the cylinder is heated or allowed to become heated through contact with the vessel such that the composition is heated to at least about 100° C. at which temperature sodium melts. In this way, the sodium melt runs into the spaces between the calcium metal chunks forming barrier layers therebetween. This prevents the wedging of the calcium metal chunks into one monolithic solid mass. The liquid sodium remains along the boundaries of the calcium metal chunks as it is extruded through the die. On reaching the interior of the vessel containing molten iron between about 1500° and 1600° C., the sodium metal rapidly vaporizes. (Sodium metal vaporizes at 880° C.) Thus, the billet extruded into the vessel quickly breaks apart. Agitation resulting from the formation of sodium vapor disperses the calcium metal in the vessel. (Calcium metal melts at 839° C. and boils at 1484° C.) Since, the boiling point of calcium is at about the melt temperature, it is theorized that calcium will go into solution and react with the oxygen and sulfur about as fast as it melts and before substantial calcium vapor bubbles form. The calcium will react with the oxygen and sulfur impurities to form oxides and sulfides which to some extent will float to the top of the molten iron forming or joining a slag layer.

According to another preferred embodiment, steel melt may be desulfurized after being deoxidized with the traditional deoxidizer additions, for example, aluminum added in the conventional way. The deoxidation step is not essential with this process as with prior art processes, however. A calcium magnesium alloy in say, one-quarter inch size hunks is blended with finely divided sodium metal, up to five percent by weight. The mixture is placed in a compaction cylinder, heated above 100° C. and pre-compacted into a billet and thereafter cooled to less than 100° C. enabling the sodium metal which had melted to cool and solidify. Thus easily transportable billets comprising calcium magnesium alloy metal with a "honeycomb" of sodium separating pea size alloy pellets is formed. The thus formed billets are then extruded into the lower portion of a vessel containing the deoxidized steel as explained for the preceding embodiment.

In yet another variation of this embodiment, the alloy billet is formed by extruding in a way that the sodium melts just prior to the die and with rapid cooling of the billet as it emerges from the die. A continuous deoxidizing and desulfurizing composition is prepared.

According to yet another embodiment, calcium metal and sodium metal are extruded into a vessel of molten copper at a temperature above about 1100° C. At these temperatures, calcium melts but does not vaporize. The calcium thus introduced will deoxidize the copper melt thereby increasing the conductivity and tensile strength of the copper.

As used in the following claims, the terms "calcium metal" and "calcium metal alloys" refer to alloys comprising up to fifty percent of ingredients other than calcium selected from the group consisting of aluminum, barium and magnesium. The calcium or calcium alloys may contain impurities so long as they do not adversely affect the composition of the molten metal, considering the purposes for which it is to be used after casting.

To demonstrate the fact that calcium-sodium mixtures can be extruded at temperatures above the melting point of sodium and well below the melting point of calcium a number of extrusion tests were conducted. The test apparatus maximized the extrusion difficulties by using a reduction form cylinder through the die of five to one with no taper between the extrusion cylinder and the die. The rate at which the billet was extruded into an argon purged atmosphere at a constant pressure (about 1100 psi) and temperature (460° C.) was taken as the measure of extrudability (the larger the rate the more easily extruded).

A mixture of 99 percent, by weight calcium and 1 percent sodium metal extruded at a rate of 0.042 inches per second. A mixture of 96.4 percent, by weight, calcium and 3.6 percent sodium extruded at a rate of 0.048 inches per second. By way of comparison, calcium metal alone was found to extrude at only 0.039 inches per second. The rate of extrusion was increased on the order of six percent for every one percent by weight sodium added. In the actual practice of this invention, tapered dies and very minimal reductions will be used to minimize the extrusion time.

The following described apparatus may be useful in the practice of the herein described method. Referring now to the drawing, there is shown a refractory ladle 10, positioned by a crane (not shown) adjacent the pouring platform 20. A movable vehicle 30 is positioned upon the platform in the vicinity of the ladle.

The ladle has a pouring nozzle 11 that is controlled by stopper and stopper rod assembly 12. The ladle has another port which is controlled by a second stopper rod assembly 14. The stopper rod assemblies are only partially shown as they are well known in the teeming art. The ladle is provided with an appropriate refractory brick lining 15. While stoppers and stopper rod assemblies have been illustrated for simplicity, those skilled in the art will recognize that slide gates are equally suitable means for controlling the pouring nozzle and the addition agent port 13.

The mobile vehicle may have a chassis with front and rear axles thereon for carrying front and rear wheels, for example, pneumatic tires. At least one axle must be steerable. The vehicle has its own motivating system with appropriate drives for moving the vehicle into position near the vessel. The basic function of the vehicle is to carry the cylinder 32 and the associated hydraulics (i.e., motor, reservoir, conduit and controls not shown). Roughly speaking, the cylinder is divided into three functional sections. The back half comprises a double acting hydraulic cylinder. The piston can be completely withdrawn into the back half of the cylinder. The frontmost quarter of the cylinder comprises an extrusion section terminating in an extrusion die, that is, a reduced section. The centermost portion comprises a loading section, i.e., the cylinder is open on one side to permit the loading of the cylinder with cartridges of extrudable additive agents. Over the loading section is a rack 33 for holding the ready to use cartridges 40 of extrudable additives. Hydraulically positionable stands 34 and 35 are arranged to remove the vehicle load from its suspension system after the cylinder has been connected to the additive agent port 13 of the vessel.

Before or after the vehicle is positioned with the cylinder engaging the ladle additive agent port, the piston is withdrawn to its rearwardmost position and a cartridge of extrudable additive agent is positioned in the cylinder. Thereafter the piston is brought forward to move the cartridge into the extruding section of the cylinder and is further advanced to extrude additive through the elbow and into the port of the ladle. At this time, the ladle port is unstopped and the piston continuously extrudes the extrudable additive into the base of the vessel through the additive agent port. When the piston reaches its extreme position toward the die end of the cylinder, a short period of time is permitted for the extrudable agent to work its way into the solution in the vicinity of the stopper seat. Thereafter, the stopper is allowed to seal the additive agent port and the piston is returned to its rearwardmost position permitting the introduction of an additional cartridge of extrudable addition agent into the cylinder. The process is repeated until sufficient additive agent has been introduced into the melt. When the addition process is complete, the vehicle is withdrawn from the vessel and the vessel is thereafter (in the case of an open hearth shop of the traditional type) teemed into the ingots adjacent the pouring platform through the teeming nozzle.

In a preferred embodiment, the die end of the cylinder is heated by heating elements 39 which may be electrical resistance or induction heating elements of the type well known in the art. In this case, it will be necessary for a flexible cable to connect the vehicle with an electrical power supply.

The embodiment illustrated in FIG. 1, shows a stopper rod assembly for closing the additive port 13. However, the port could very well be closed by a slide gate of the three plate type in which an apertured plate slides between two fixed apertured surfaces. The alignment of the aperture in the movable plate with the other apertures places the elbow in communication with the vessel interior. Preferably, the extrudable addition agent will be forced into the elbow just below the sliding plate. Thus when the gate is opened the molten metal will not rush into the elbow. The piston then extrudes the additive into the vessel. Near the end of the piston stroke the slide gate will be closed while the aperture is filled with the extrudable additive agent. The temperature of the extrudable agent by the time it reaches the slide gate will render it sufficiently plastic that the gate will simply shear the column of additive in order to move the apertures out of alignment.

Having thus defined the invention with the detail and particularity required by the Patent Laws, what is desired protected by Letters Patent is set forth in the following claims.

I claim:

1. A method of treating molten metals comprising steps for:

heating and extruding into a lower portion of a vessel containing molten metal, a composition comprising calcium metal and sodium metal, said composition being heated prior to entering the vessel to a temperature above the melting point of sodium and below the melting point of calcium, said sodium being present from about one-half percent by weight to about fourteen percent by weight of the composition in amounts and with volume distribution such that upon entering the molten metal, the immediately melted and vaporized sodium aids the dispersion of the calcium within the molten metal.

2. The method according to claim 1 in which the composition is heated to a temperature between 400° and 600° C. to facilitate extrusion.

3. The method according to claim 1 in which the sodium in the composition is distributed along the boundaries of calcium metal chunks.

4. The method according to claim 1 in which said vessel has a bottom and the composition is extruded through the bottom of said vessel.

5. A method of deoxidizing ferrous melts comprising steps for heating and extruding into a lower portion of a vessel containing the ferrous melt, a composition comprising calcium metal and sodium metal, said composition heated to at least 400° C. and below the melting point of calcium, said sodium being present from about one-half percent by weight to five percent by weight of the composition in amounts and with volume distribution such that upon entering the molten metal, the immediately melted and vaporized sodium aids the dispersion of the calcium within the molten metal to react with oxygen and oxides therein.

6. A method of treating molten metals comprising steps for:

heating and extruding into a lower portion of a vessel containing molten metal, a composition comprising calcium metal and sodium metal, said composition being heated at least prior to entering the vessel to a temperature above the melting point of sodium and below the melting point of calcium, said sodium being present from about one-half percent by weight to about ten percent by weight of the composition, said sodium being distributed along the boundaries of calcium metal chunks.

7. The method according to claim 1 in which said vessel has a side wall and the composition is extruded through the side walls.

* * * * *